US010639917B2

(12) United States Patent
Hamada

(10) Patent No.: US 10,639,917 B2
(45) Date of Patent: May 5, 2020

(54) PRINTING APPARATUS AND METHOD OF FIXING SUPPORT UNIT

(71) Applicant: SEIKO EPSON CORPORATION, Tokyo (JP)

(72) Inventor: Nobuhiko Hamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/156,968

(22) Filed: Oct. 10, 2018

(65) Prior Publication Data

US 2019/0118565 A1 Apr. 25, 2019

(30) Foreign Application Priority Data

Oct. 19, 2017 (JP) ..... 2017-202413

(51) Int. Cl.

| | |
|---|---|
| ***B41J 29/02*** | (2006.01) |
| ***B41J 3/407*** | (2006.01) |
| ***B41J 11/06*** | (2006.01) |
| ***B41J 29/04*** | (2006.01) |
| ***B41J 29/13*** | (2006.01) |

(52) U.S. Cl.

CPC ..... *B41J 29/04* (2013.01); *B41J 3/4078* (2013.01); *B41J 11/06* (2013.01); *B41J 29/02* (2013.01); *B41J 29/13* (2013.01)

(58) Field of Classification Search

CPC ... B41J 29/02; B41J 29/04; B41J 11/02; B41J 11/06; B41J 3/4078

See application file for complete search history.

(56) References Cited

U.S. PATENT DOCUMENTS

2018/0056675 A1* 3/2018 Watanabe ..... B41J 11/002
2019/0111710 A1* 4/2019 Enomoto ..... B41J 11/06

FOREIGN PATENT DOCUMENTS

JP 2005068595 A * 3/2005
JP 2017-140710 A 8/2017

OTHER PUBLICATIONS

Takehara, MachineTranslationofJP2005-068595A.pdf (Year: 2005).*

* cited by examiner

*Primary Examiner* — Scott A Richmond
(74) *Attorney, Agent, or Firm* — Workman Nydegger

(57) ABSTRACT

A printing apparatus includes a supporting unit for a medium including an insertion part on which an indented part is provided, a base unit including an insertion inlet for the insertion part, the base unit being configured to have the supporting unit attach and detach to/from the base unit, and a fixing part configured to, when the insertion part is inserted up to a fixing position, fix the insertion part at the fixing position. The fixing part includes a first fixing part and a second fixing part. When the insertion part is inserted up to the fixing position, the first fixing part is configured to engage with the indented part when the indented part is located at a facing position, and the second fixing part is configured to not engage with the indented part when the indented part is located at a facing position.

9 Claims, 20 Drawing Sheets

PRINTING APPARATUS AND METHOD OF FIXING SUPPORT UNIT

BACKGROUND

1. Technical Field

The invention relates to a printing apparatus and a method of fixing a support unit.

2. Related Art

Printing apparatuses of various configurations have been used. Of such printing apparatuses, printing apparatuses having a configuration in which a supporting unit for a medium is supported by a base unit have been used.

For example, JP-A-2017-140710 discloses a printing apparatus having a configuration in which a supporting unit including an insertion part is inserted into a base unit including an insertion inlet to allow the base unit to support the supporting unit.

The printing apparatus disclosed in JP-A-2017-140710 has a configuration in which, when the insertion part is inserted up to a fixing position, the insertion part is fixed to the base unit (the insertion inlet). Therefore, the printing apparatus disclosed in JP-A-2017-140710 has a configuration in which the supporting unit can be securely fixed.

However, in such printing apparatuses having a configuration in which, when the insertion part is inserted up to the fixing position, the insertion part is fixed to the base unit, some configurations of the fixing part may cause difficulty in releasing the fixation of the supporting unit when, in particular, for example, the supporting unit is set in a wrong orientation in relation with the base unit.

An advantage of some aspects of the invention is that a supporting unit is securely fixed and also difficulty in releasing fixation of the supporting unit is prevented even when, for example, the supporting unit is set in a wrong orientation.

SUMMARY

A printing apparatus according to a first aspect of the invention includes a supporting unit including an insertion part on which an indented part is provided, the supporting unit being configured to support a medium, a base unit including an insertion inlet into which the insertion part is insertable, the base unit being configured to have the supporting unit attach and detach to/from the base unit along an attachment/detachment direction, and a fixing part configured to, when the insertion part is inserted into the insertion part up to a fixing position, fix the insertion part to the insertion inlet at the fixing position. The fixing part includes a first fixing part provided on one side in an intersecting direction which intersects with the attachment/detachment direction, and a second fixing part provided on the other side in the intersecting direction. When the insertion part is inserted up to the fixing position, the first fixing part is configured to engage with the indented part when the indented part is located at a position facing the first fixing part, and the second fixing part is configured to not engage with the indented part when the indented part is located at a position facing the second fixing part.

In this aspect, the first fixing part configured to engage with the indented part when the indented part is located at the facing position and the second fixing part configured to not engage with the indented part when the indented part is located at the facing position, when the insertion part is inserted up to the fixing position, are included. That is, the indented part engages with the first fixing part but does not engage with the second fixing part. Thus, when the supporting unit is set in the correct orientation (when the indented part is located at the position facing the first fixing part), the supporting unit can be securely fixed. In addition, even when the supporting unit is set in a wrong orientation (when the indented part is located at the position facing the second fixing part), difficulty in releasing the fixation of the supporting unit can be prevented.

A printing apparatus according to a second aspect of the invention is the printing apparatus according to the first aspect, in which a non-indented part is provided on the insertion part at a position different from the indented part in the attachment/detachment direction, and the second fixing part is configured to, when the insertion part is inserted up to the fixing position and the indented part is located at a position facing the second fixing part, come into contact with the non-indented part and not engage with the indented part.

In this aspect, the second fixing part is configured to come into contact with the non-indented part and thus not engage with the indented part. Thus, a simple configuration can be made in which the second fixing part does not engage with the indented part.

A printing apparatus according to a third aspect of the invention is the printing apparatus according to the second aspect, in which the second fixing part is configured to, when the insertion part is inserted up to the fixing position and the indented part is located at a position facing the second fixing part, come into contact with the non-indented part provided at a position on a lower side with respect to the indented part in the attachment/detachment direction.

In this aspect, the second fixing part is configured to come into contact with the non-indented part provided at a position on the lower side with respect to the indented part in the attachment/detachment direction. Therefore, the second fixing part can be prevented from being caught by the indented part when the supporting unit is detached from the base unit.

A printing apparatus according to a fourth aspect of the invention is the printing apparatus according to any one of the first to third aspects, in which a length of the second fixing part in the attachment/detachment direction is greater than a length of the first fixing part in the attachment/detachment direction.

In the aspect, the length of the second fixing part in the attachment/detachment direction is greater than a length of the first fixing part in the attachment/detachment direction. Thus, a simple configuration can be made in which the second fixing part is made to come into contact with the non-indented part, for example, and thus the second fixing part does not engage with the indented part.

A printing apparatus according to a fifth aspect of the invention is the printing apparatus according to any one of the first to fourth aspects, including a pressing part configured to, when the insertion part is inserted up to the fixing position, press the insertion part in a pressing direction toward the first fixing part in the intersecting direction.

In this aspect, the pressing part configured to, when the insertion part is inserted up to the fixing position, press the insertion part in the pressing direction toward the first fixing part in the intersecting direction is included, thus the first fixing part and the indented part can be engaged with a simple configuration and the supporting unit can be fixed as appropriate with a simple configuration.

A printing apparatus according to a sixth aspect of the invention is the printing apparatus according to the fifth aspect, an engagement between the first fixing part and the indented part is released from a state in which the first fixing part and the indented part engage with each other by moving the supporting unit in an opposite direction of the pressing direction.

In this aspect, the engagement between the first fixing part and the indented part is released from a state in which the first fixing part and the indented part engage with each other by moving the supporting unit in the opposite direction of the pressing direction. Thus, pressing in the opposite direction of the pressing direction can easily release the fixation of the supporting unit in the first fixing part.

A printing apparatus according to a seventh aspect of the invention is the printing apparatus according to any one of the first to sixth aspects, in which the insertion part includes the indented part provided at least on one side in the intersecting direction and on the other side in the intersecting direction.

In this aspect, the insertion part includes the indented part provided at least on one side in the intersecting direction and on the other side in the intersecting direction. Thus, the supporting unit can be securely fixed to the base unit in two types of orientation, and in both the two types of orientation the difficulty in releasing the fixation of the supporting unit can be prevented.

A printing apparatus according to an eighth aspect of the invention is the printing apparatus according to the seventh aspect, in which the insertion part includes the indented part provided to make one lap around the outer peripheral surface in the intersecting direction.

In this aspect, the insertion part includes the indented part provided to make one lap around the outer peripheral surface in the intersecting direction. Thus, the supporting unit can be securely fixed to the base unit in a plurality of types of orientation, and when the indented part is formed, the indented part is formed when rotating the insertion part with the attachment/detachment direction as the axis, and thus the indented part can be easily formed.

A method of fixing a support unit according to a ninth aspect of the invention is the method of fixing a support unit in a printing apparatus including a supporting unit including an insertion part on which an indented part is provided, the supporting unit being configured to support a medium, a base unit including an insertion inlet into which the insertion part is insertable, the base unit being configured to have the supporting unit attach and detach to/from the base unit along an attachment/detachment direction, and a fixing part configured to, when the insertion part is inserted into the insertion inlet up to a fixing position, fix the insertion part to the insertion inlet at the fixing position, wherein the fixing part includes a first fixing part provided on one side in an intersecting direction which intersects with the attachment/detachment direction, and a second fixing part provided on the other side in the intersecting direction. The method includes fixing the supporting unit at the fixing position by, when the insertion part is inserted up to the fixing position, engaging the first fixing part with the indented part when the indented part is located at a position facing the first fixing part, and not engaging the second fixing part with the indented part when the indented part is located at a position facing the second fixing part.

In this aspect, when the insertion part is inserted up to the fixing position and the indented part is located at the facing position, the first fixing part is engaged with the indented part but the second fixing part is not engaged with the indented part. That is, the indented part engages with the first fixing part but does not engage with the second fixing part. Thus, when the supporting unit is set in the correct orientation (when the indented part is located at the position facing the first fixing part), the supporting unit can be securely fixed. In addition, even when the supporting unit is set in a wrong orientation (when the indented part is located at the position facing the second fixing part), difficulty in releasing the fixation of the supporting unit can be prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printing apparatus 1 according to an example of the invention will be described in detail with reference to the appended drawings.

Example 1 (FIG. 1 to FIG. 16)

Figure 1:
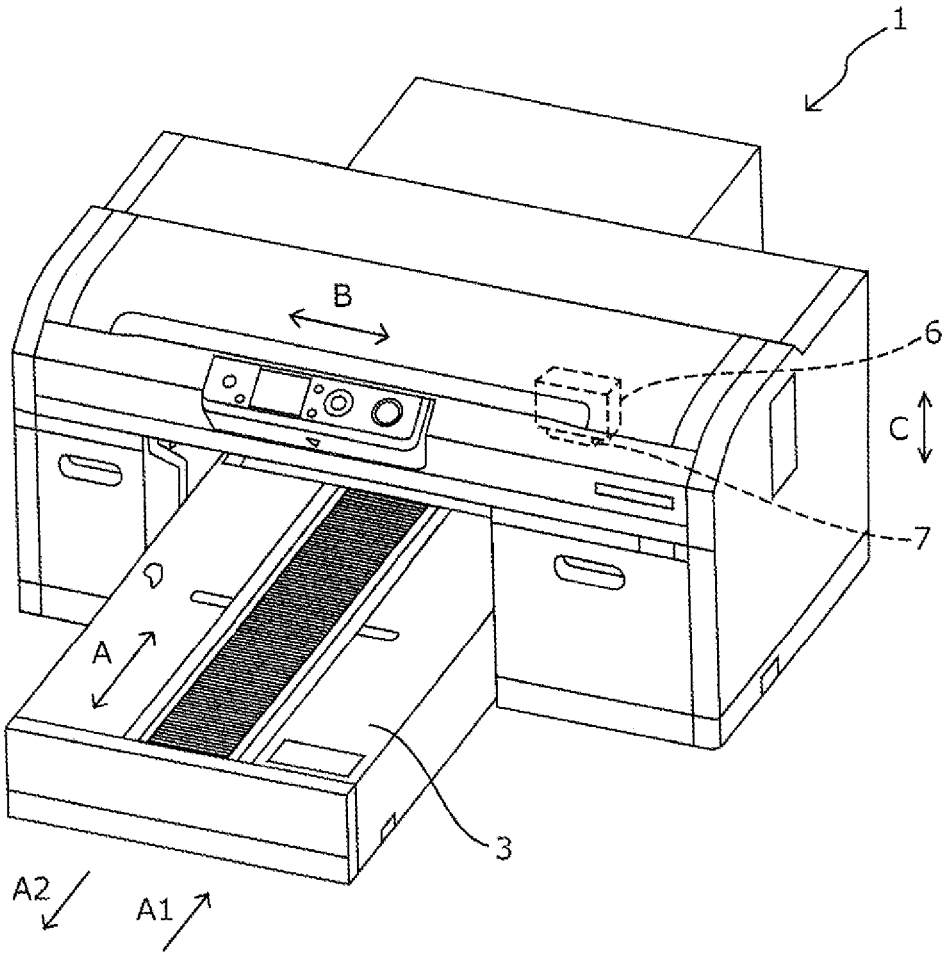
FIG. 1 is a schematic perspective view of a printing apparatus according to Example 1 of the invention.
Figure 2:
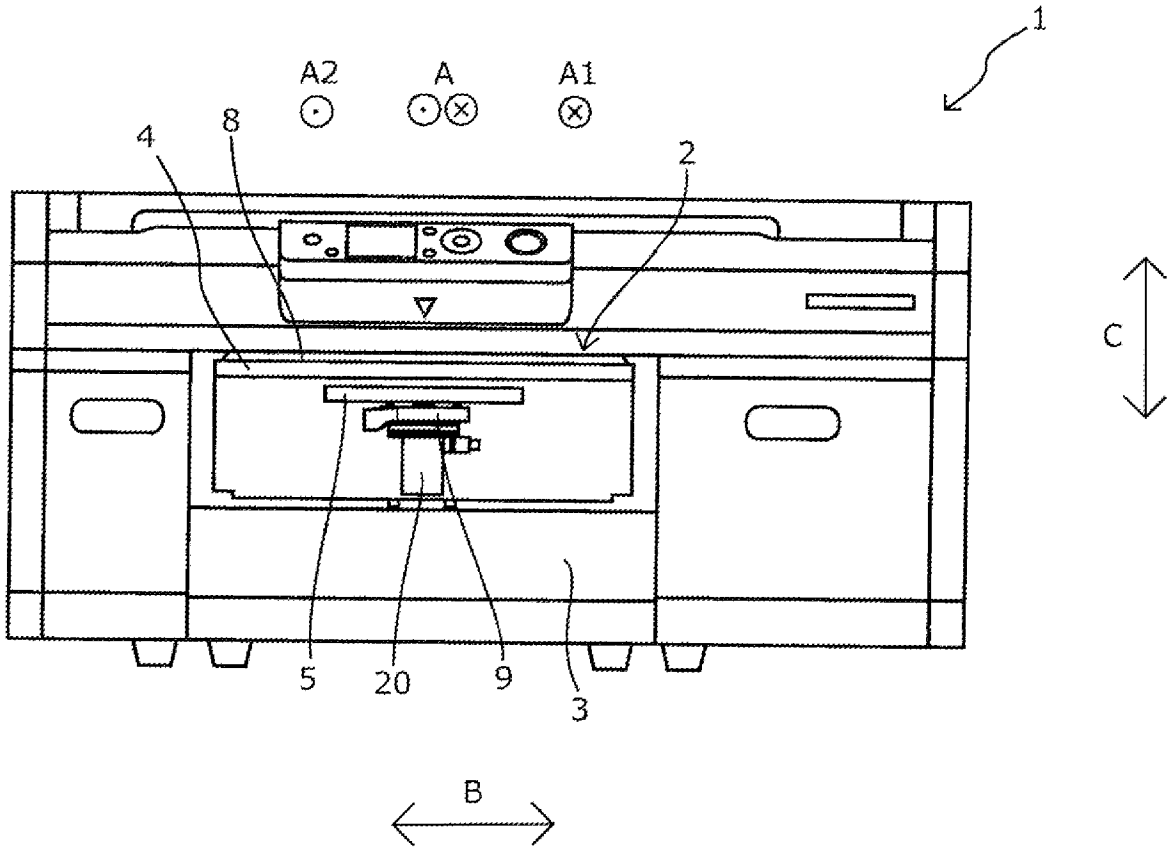
FIG. 2 is a schematic front view of the printing apparatus according to Example 1 of the invention.
Figure 3:
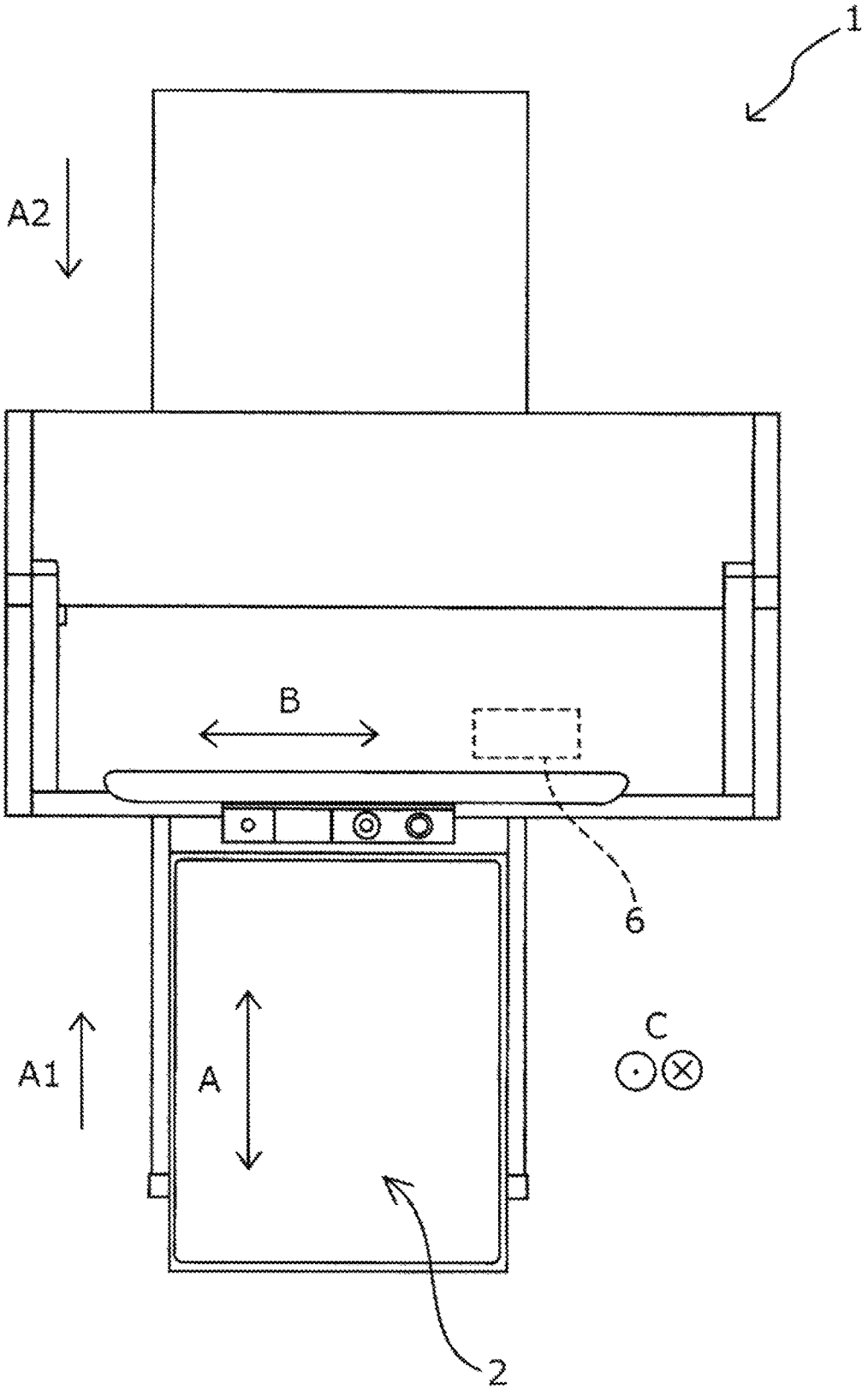
FIG. 3 is a schematic plan view of the printing apparatus according to Example 1 of the invention.
Figure 4:
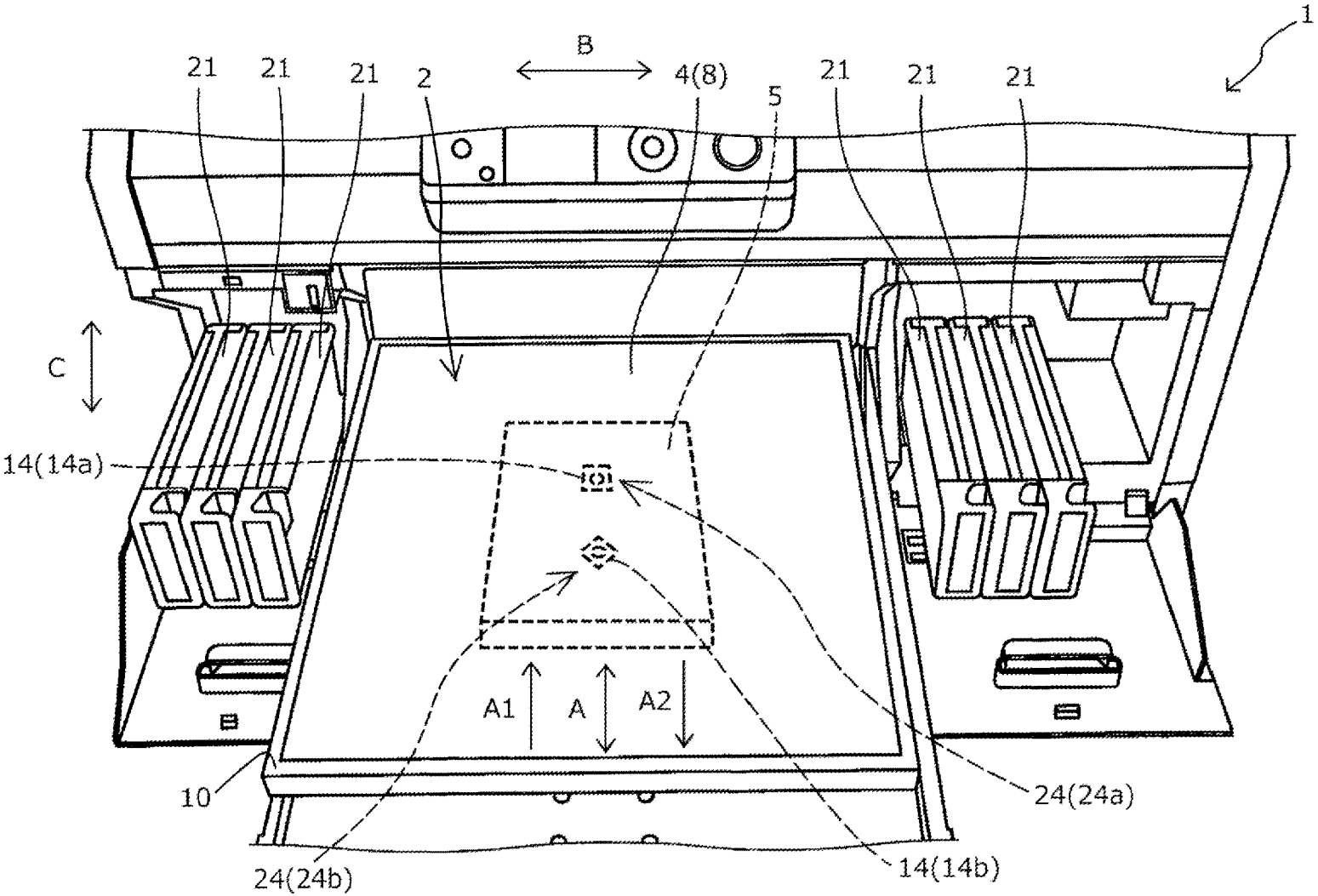
FIG. 4 is a schematic perspective view of the printing apparatus according to Example 1 of the invention.

FIG. 1 is a schematic perspective view of the printing apparatus 1 according to the example, and illustrates a state in which a medium support unit 2 is in a printing start position. In addition, FIG. 2 is a schematic front view of the printing apparatus 1 according to the example. Furthermore, FIG. 3 is a schematic plan view of the printing apparatus 1 according to the example, and illustrates a state in which the medium support unit 2 is in a setting position of a medium M (refer to FIG. 5). Also, FIG. 4 is a schematic perspective view of the printing apparatus 1 according to the example, viewed from another angle from FIG. 1, and illustrates a state in which the medium support unit 2 is in the setting position and a state in which a part of a cover portion included in a housing unit is open. Note that FIG. 1 to FIG. 4 illustrate a state with some component elements simplified. Here, the printing start position is a start position for the medium support unit 2 when the printing onto the medium M is started, and the setting position is a stop position for the medium support unit 2 when the medium M is set into the medium support unit 2.

The printing apparatus 1 according to the example includes the medium support unit 2, which moves in a movement direction A in a state of supporting the medium M. The medium support unit 2 includes a tray 4, which is a supporting unit that supports the medium M. The tray 4 includes a support surface 8 and supports the medium M with the support surface 8. The printing apparatus 1 includes a medium transporting unit 3, which transports the medium M supported by the tray 4 in the movement direction A. The movement direction A is a direction including a direction A1 and a direction A2 opposite from the direction A1. In addition, the tray 4 is detachably mounted on a stage 5, which functions as a base unit. Here, an attachment/detachment direction C of the tray 4 to/from the stage 5 corresponds to the vertical direction for the printing apparatus 1 according to the example. A lever 9 is a component that adjusts the height of the tray 4 (the distance of the tray 4 from a print head 7). Rotating the lever 9 causes the tray 4 to move in a direction corresponding to the attachment/detachment direction C (in the vertical direction) along with the stage 5. Note that as illustrated in FIG. 2, the lever 9 is provided to an arm unit 20 of the medium support unit 2. A variety of materials can be used as the medium M, including textiles (fabric, cloth, and the like), paper, vinyl chloride resin, and the like.

The printing apparatus 1 includes, in its interior, a print head 7 that can print onto the medium M by discharging ink, which is an example of a liquid. Note that the ink is supplied from a plurality of ink cartridges 21 (refer to FIG. 4), one for each color, to the print head 7. The printing apparatus 1 according to the example moves a carriage 6 to which the print head 7 is provided back and forth in a scanning direction B which intersects with the movement direction A. The printing apparatus 1 thus forms an intended image by discharging ink from the print head 7 onto the medium M supported by the tray 4 while moving the print head 7 back and forth in the scanning direction B.

Note that in the printing apparatus 1 according to the example, the front side (the lower-left direction) in FIG. 1 corresponds to the setting position of the medium M on the tray 4 (see FIG. 3 and FIG. 4). The tray 4 on which the medium M is set is moved in the direction A1 of the movement direction A until the tray 4 reaches the printing start position on the rear side (the upper-right direction) in FIG. 1. The printing is then carried out while the tray 4 is moved in the direction A2 of the movement direction A.

The printing apparatus 1 according to the example includes the print head 7 configured to print while moving back and forth in the scanning direction B. However, the printing apparatus may instead include what is known as a line head, in which a plurality of nozzles that discharge ink are provided in an intersecting direction which intersects with the movement direction of the medium M.

Here, a "line head" is a print head provided such that a region including the nozzles formed in the intersecting direction which intersects with the movement direction of the medium M is configured to cover the entirety of that intersecting direction, and is used in a printing apparatus which forms an image by moving at least one of the print head and the medium M relative to each other. Note that in the line head, the region including the nozzles in the intersecting direction may not be configured to cover the intersecting direction for all types of media that can be used in the printing apparatus.

In addition, the print head 7 according to the example is a printing unit configured to print onto the medium M by discharging ink. However, the printing unit is not limited to this example. For example, a transfer printing unit, which transfers a color material onto a medium to print may be used.

A main part of the printing apparatus 1 according to the example will be described next.

Figure 5:
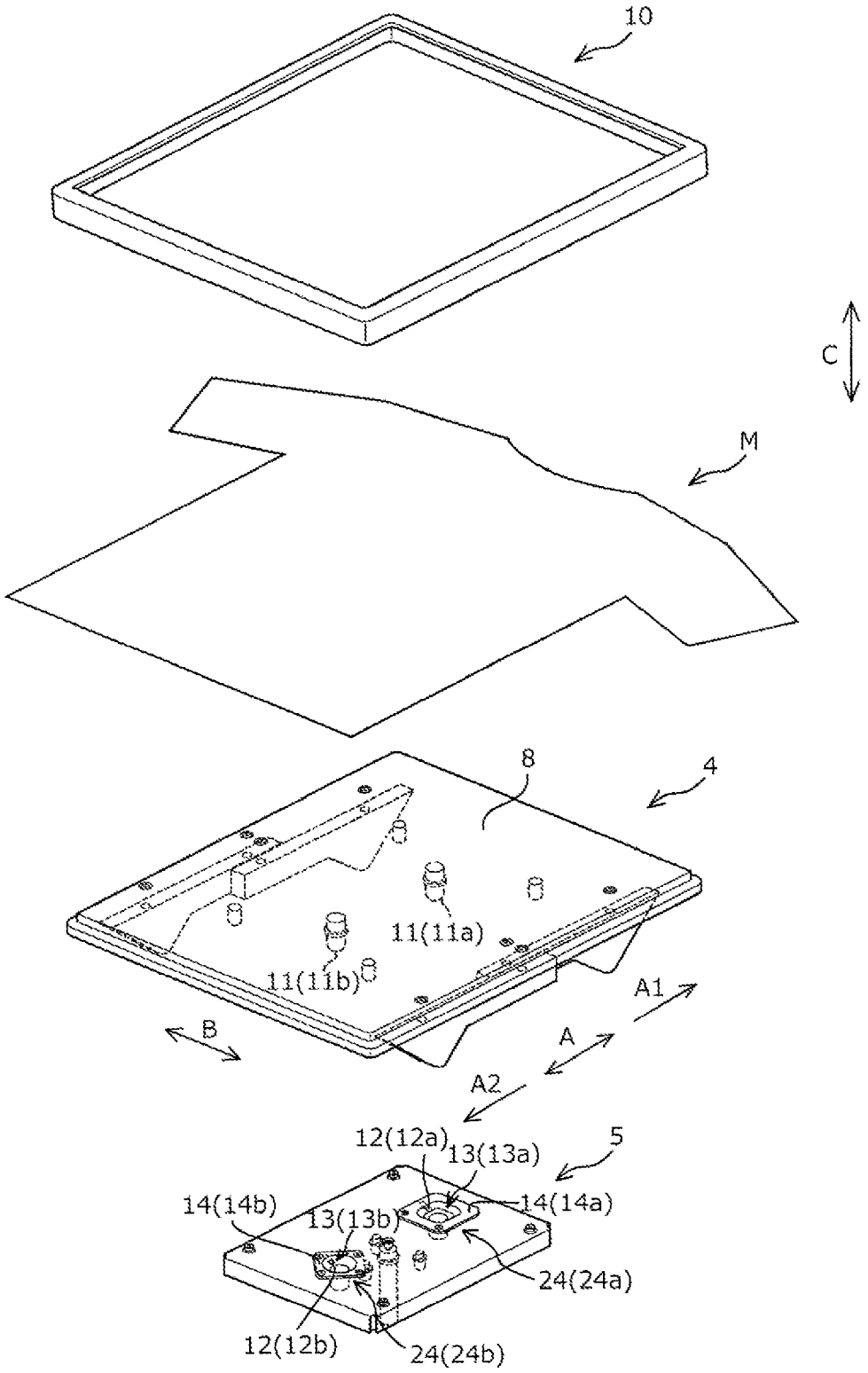
FIG. 5 is a schematic perspective view illustrating a main part of the printing apparatus according to Example 1 of the invention.
Figure 6:
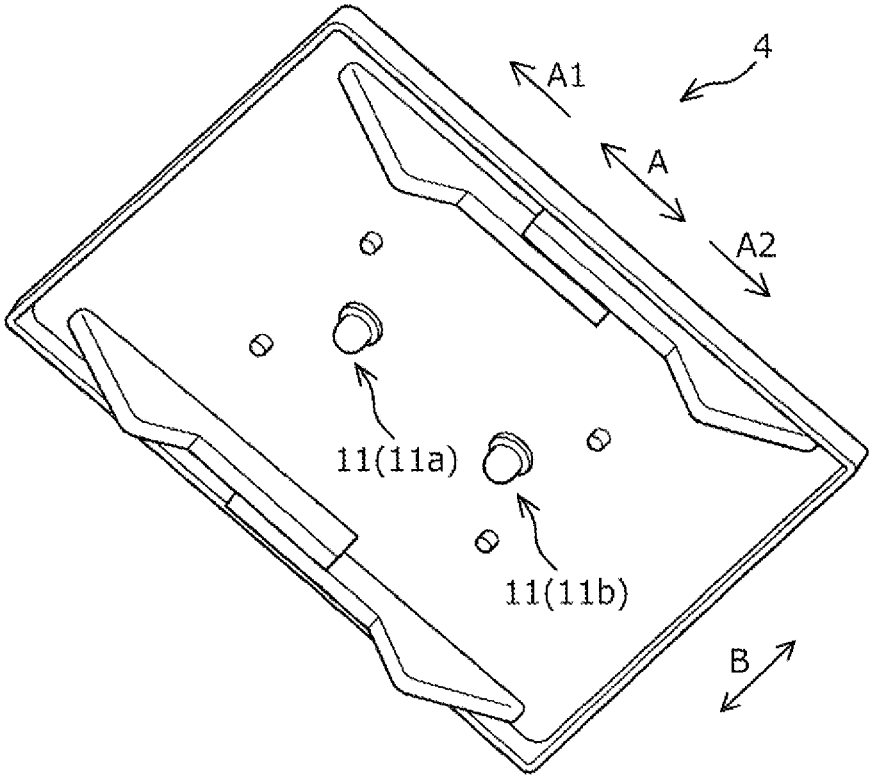
FIG. 6 is a schematic perspective view illustrating a main part of the printing apparatus according to Example 1 of the invention.
Figure 7:
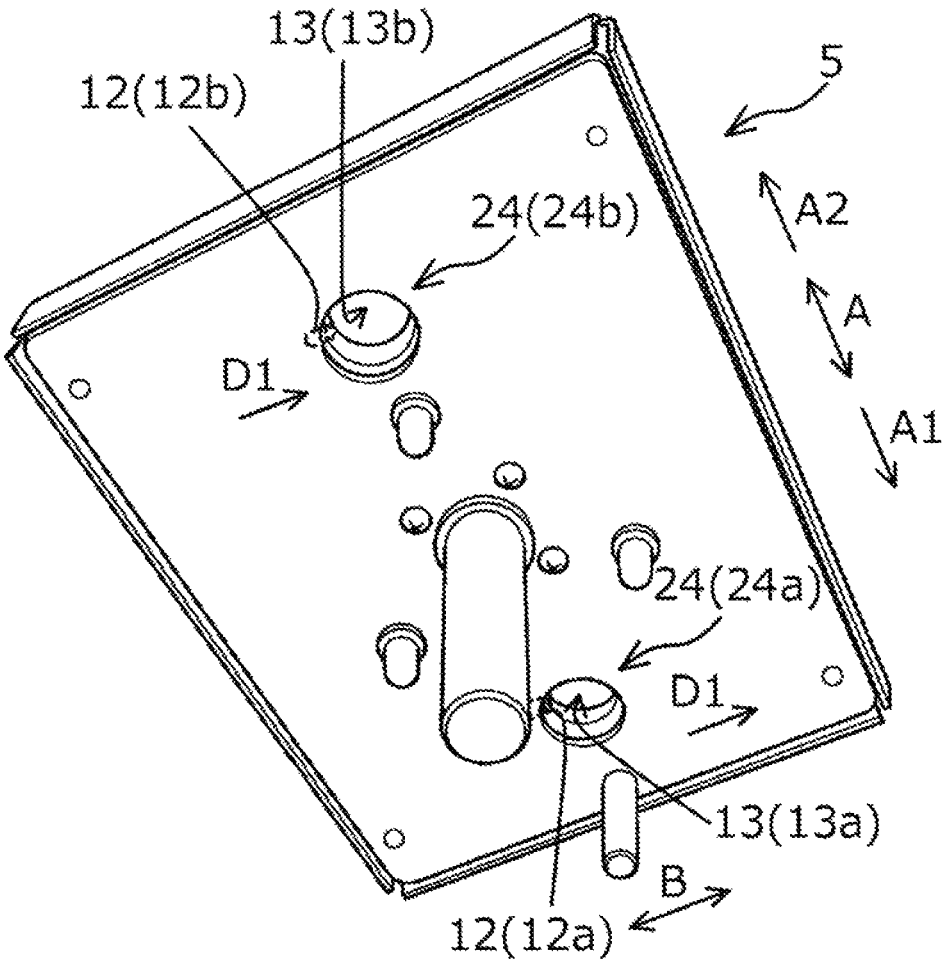
FIG. 7 is a schematic perspective view illustrating a main part of the printing apparatus according to Example 1 of the invention.

FIG. 5 is a schematic perspective view illustrating the tray 4, the stage 5, and the like included in the medium support unit 2, which is a main part of the printing apparatus 1 according to the example. In addition, FIG. 6 is a schematic perspective view illustrating the tray 4, which is a main part of the printing apparatus 1 according to the example, viewed from a bottom side (the opposite side of the support surface 8). Furthermore, FIG. 7 is a schematic perspective view illustrating the stage 5, which is a main part of the printing apparatus 1 according to the example, viewed from a bottom side (the opposite side of the side supporting the tray 4).

As illustrated in FIG. 5, the medium support unit 2 according to the example has a configuration in which the medium M is supported by the support surface 8 of the tray 4 and a frame unit 10 is fitted to the tray 4 supporting the medium M to position and fix the medium M to the support surface 8 of the tray 4.

In addition, as illustrated in FIG. 5 and FIG. 6, on the bottom side of the tray 4, insertion parts 11 (insertion parts 11*a* and 11*b*) are formed. On the other hand, as illustrated in FIG. 5 and FIG. 7, on the bottom side of the stage 5, bushes 14 (bushes 14*a* and 14*b*) are included as fixing members, and insertion inlets 13 (the insertion inlet 13*a* and 13*b*) in which the insertion parts 11 are insertable are formed in the bushes 14. The stage 5 has a configuration in which the tray 4 is attachable/detachable along the attachment/detachment direction C. Note that the insertion inlet 13*a* of the bush 14*a* corresponds to the insertion part 11*a* and the insertion inlet 13*b* of the bush 14*b* corresponds to the insertion part 11*b*.

In addition, on the lower side of the bushes 14 (the opposite side to where the tray 4 is mounted), pressing parts 12 (a pressing part 12*a* corresponding to the insertion part 11*a* and a pressing part 12*b* corresponding to the insertion part 11*b*) are formed that press the insertion parts 11 inserted into the insertion inlets 13 in the pressing direction D1. Furthermore, the bushes 14 and the pressing parts 12 constitute fixing parts 24 (fixing parts 24*a* and 24*b*) to which the tray 4 is fixable when the tray 4 is mounted.

The fixing parts 24 of the printing apparatus 1 according to the example will be described next.

Figure 8:
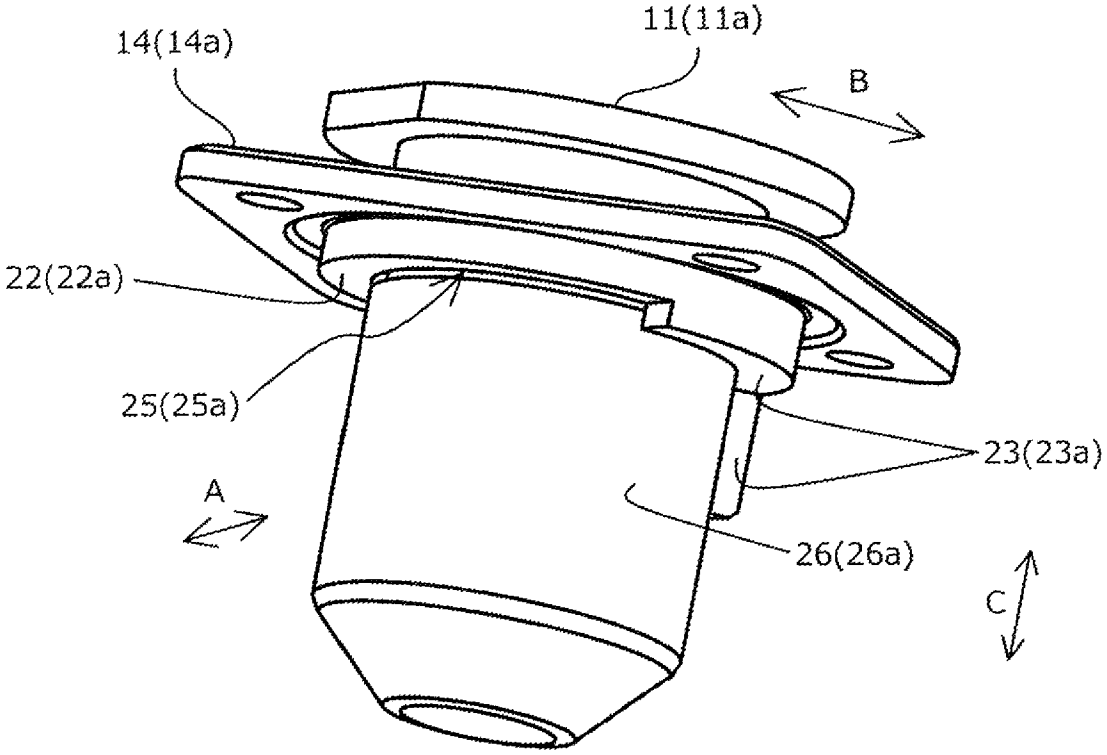
FIG. 8 is a schematic perspective view illustrating a main part of the printing apparatus according to Example 1 of the invention.
Figure 9:
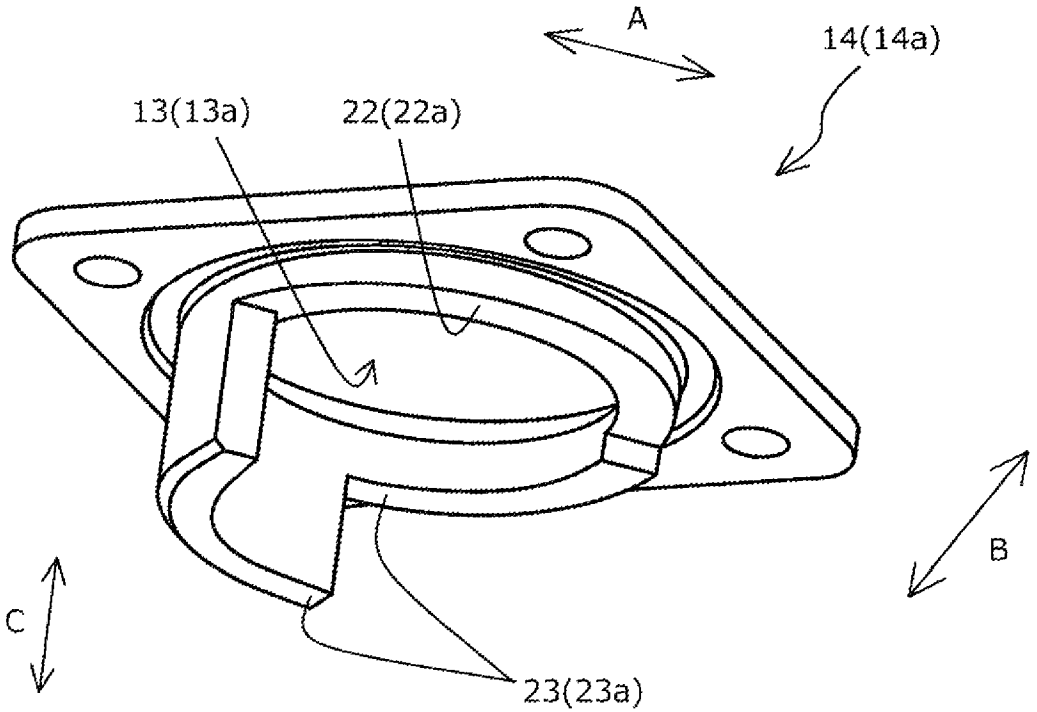
FIG. 9 is a schematic perspective view illustrating a main part of the printing apparatus according to Example 1 of the invention.
Figure 10:
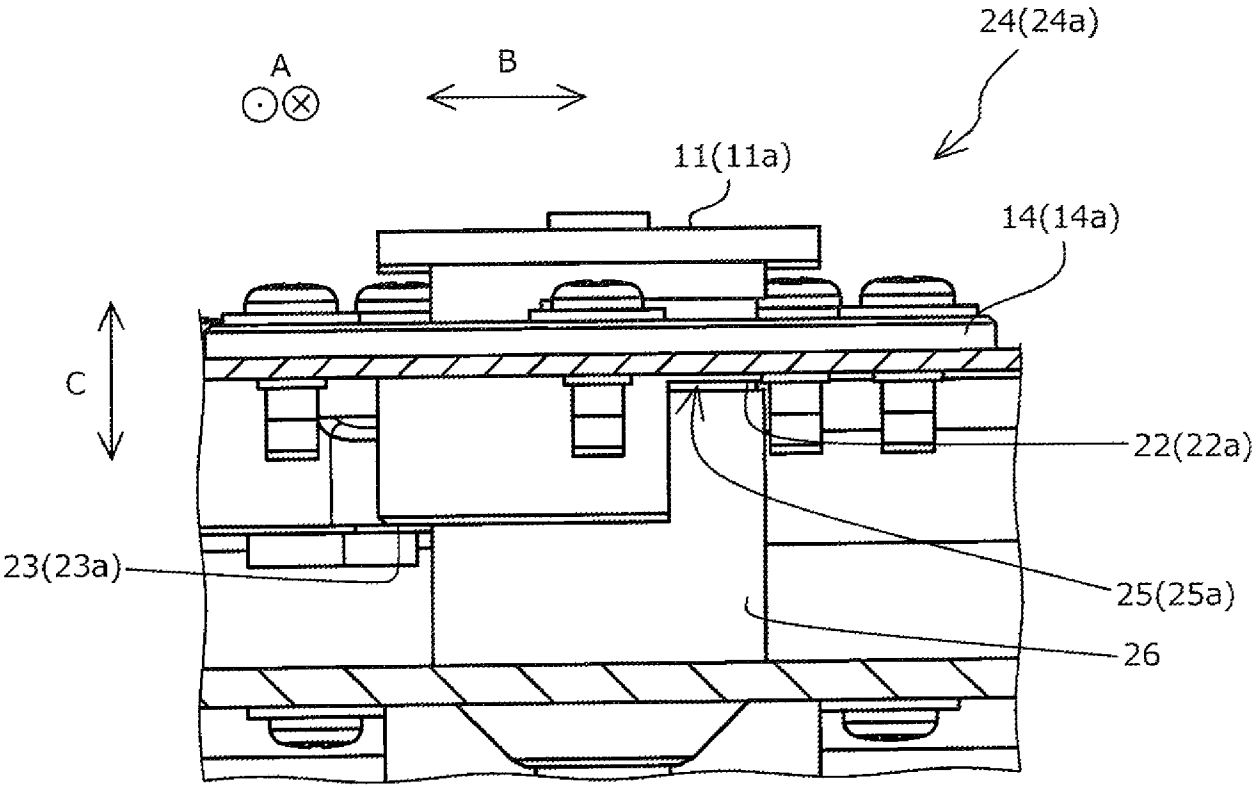
FIG. 10 is a schematic front cross-sectional view illustrating a main part of the printing apparatus according to Example 1 of the invention.

FIG. 8 is a schematic perspective view of the insertion part 11*a* and the bush 14*a*, corresponding to the fixing part 24*a* of the fixing parts 24, illustrating a state in which the tray 4 is fixed by the fixing part 24*a* (a state in which the insertion part 11*a* is inserted into the insertion inlet 13*a* of the bush 14*a* up to a fixing position). In addition, FIG. 9 is a schematic perspective view illustrating the bush 14*a* in the fixing part 24*a* of the fixing parts 24. Furthermore, FIG. 10 is a schematic front cross-sectional view of the fixing part 24*a*, illustrating a state in which the tray 4 is fixed by the fixing part 24*a*.

Figure 11:
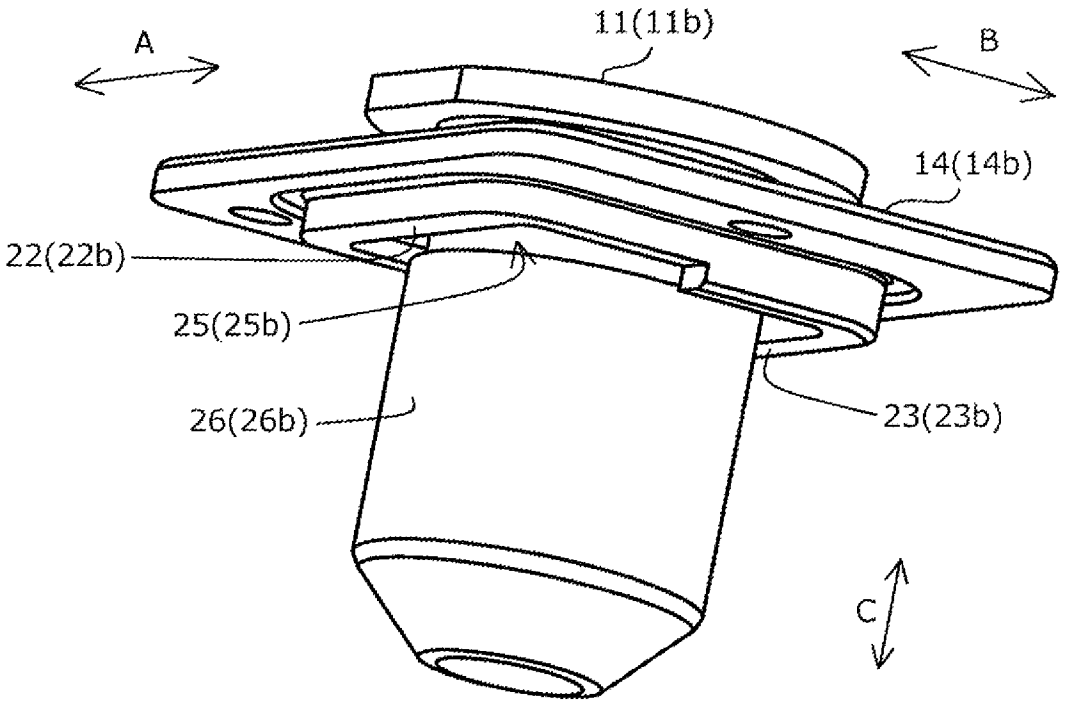
FIG. 11 is a schematic perspective view illustrating a main part of the printing apparatus according to Example 1 of the invention.
Figure 12:
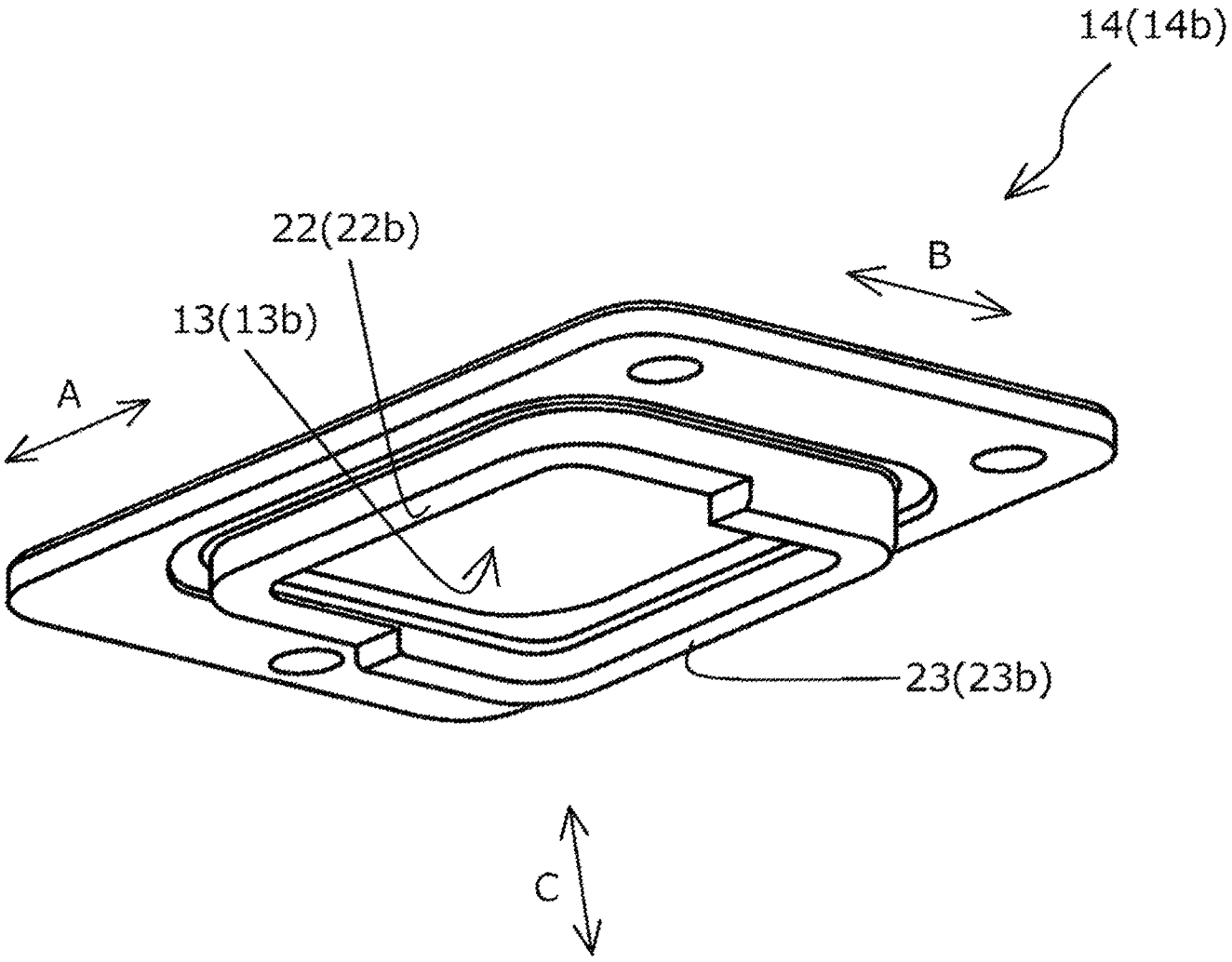
FIG. 12 is a schematic perspective view illustrating a main part of the printing apparatus according to Example 1 of the invention.
Figure 13:
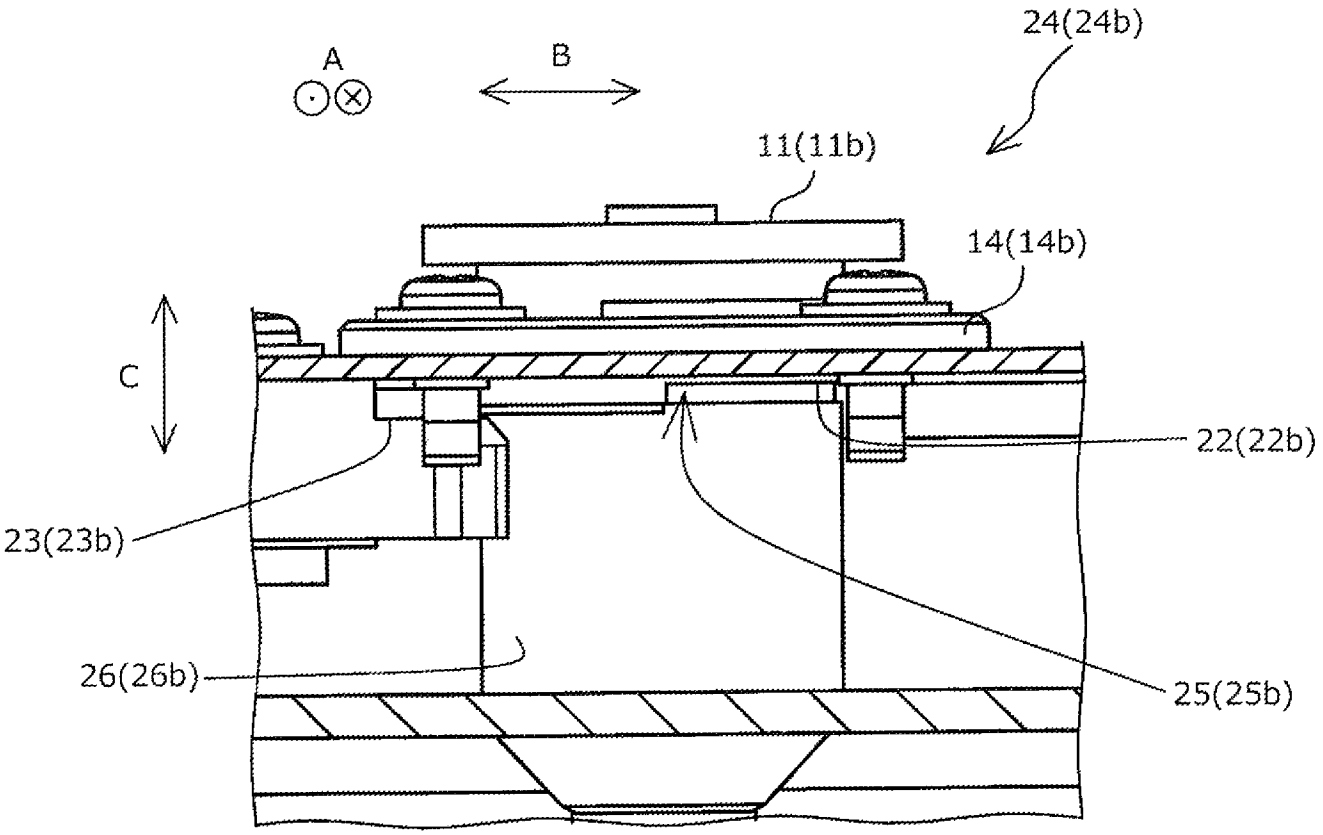
FIG. 13 is a schematic front cross-sectional view illustrating a main part of the printing apparatus according to Example 1 of the invention.

In addition, FIG. 11 is a schematic perspective view of the insertion part 11*b* and the bush 14*b*, corresponding to the fixing part 24*b* of the fixing parts 24, illustrating a state in which the tray 4 is fixed by the fixing part 24*b*. In addition, FIG. 12 is a schematic perspective view illustrating the bush 14*b* in the fixing part 24*b* of the fixing parts 24. Furthermore, FIG. 13 is a schematic front cross-sectional view of the fixing part 24*b*, illustrating a state in which the tray 4 is fixed by the fixing part 24*b*.

Figure 14:
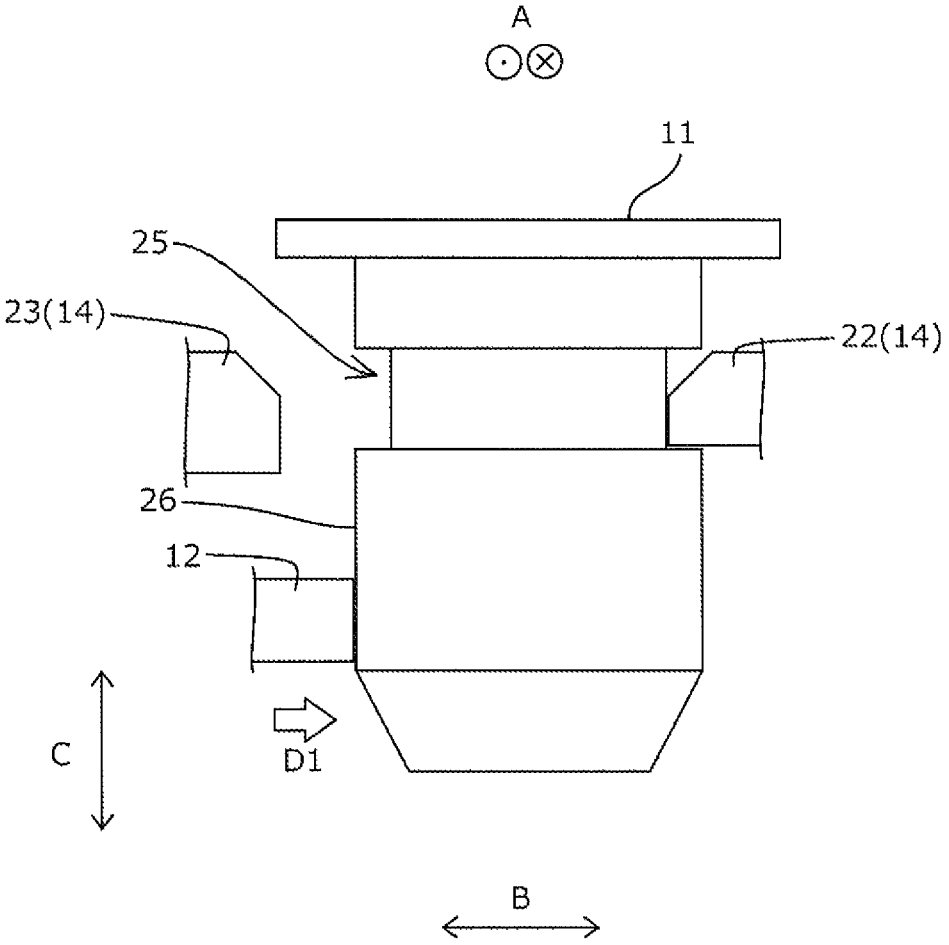
FIG. 14 is a schematic front cross-sectional view illustrating a main part of the printing apparatus according to Example 1 of the invention.
Figure 15:
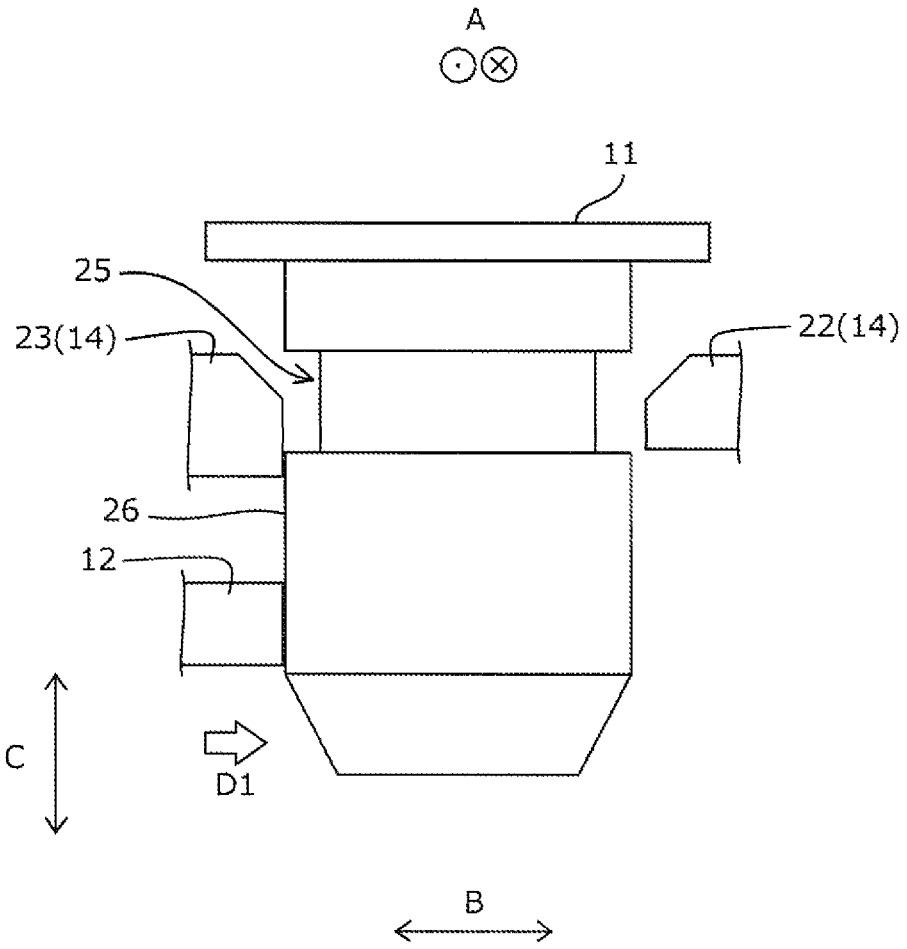
FIG. 15 is a schematic front cross-sectional view illustrating a main part of the printing apparatus according to Example 1 of the invention.

In addition, FIG. 14 and FIG. 15 are schematic front cross-sectional views of the fixing part 24 illustrating a state in which the insertion part 11 is inserted into the insertion inlet 13 of the bush 14 up to the fixing position. FIG. 14 and FIG. 15 are cross-sectional views sectioned at different position from FIG. 10 and FIG. 13. FIG. 14 illustrates a state in which the insertion part 11 is pressed by the pressing part 12 in the pressing direction D1 (a state in which the tray 4 is fixed). FIG. 15 illustrates a state in which the insertion part 11 is pressed by a user toward the opposite side of the pressing direction D1 (a state in which fixation of the tray 4 is released). Note that FIG. 14 and FIG. 15 are both schematic views and correspond to both the fixing parts 24*a* and 24*b* of the fixing parts 24.

Figure 16:
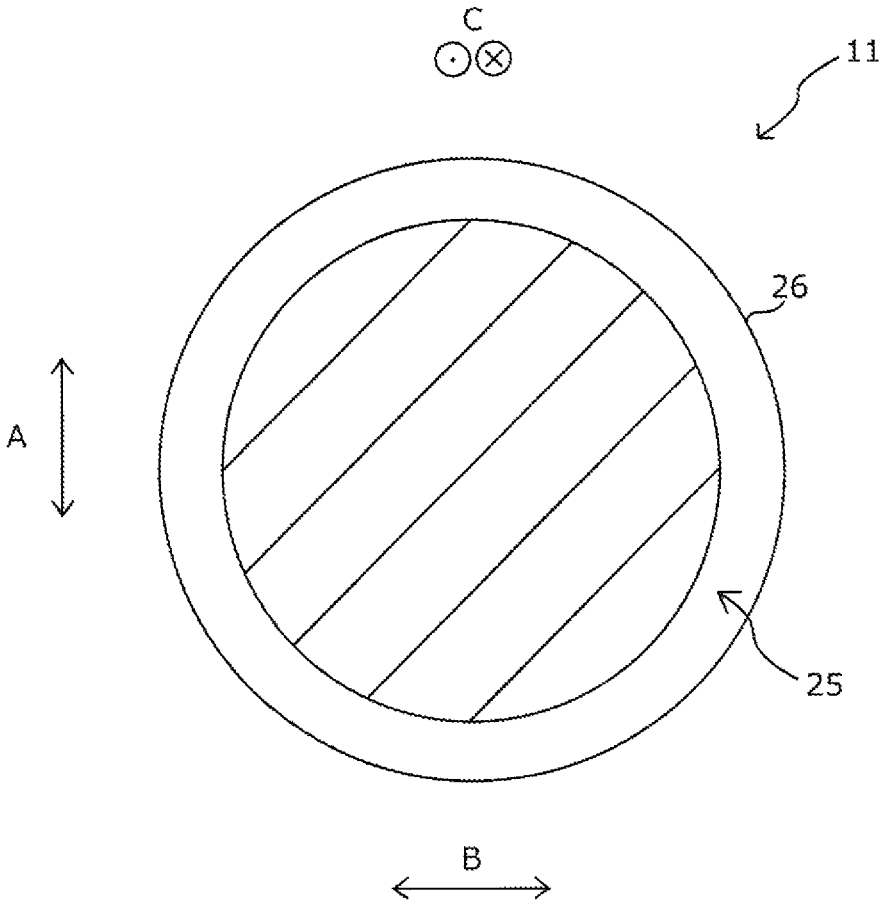
FIG. 16 is a schematic plan cross-sectional view illustrating a main part of the printing apparatus according to Example 1 of the invention.

In addition, FIG. 16 illustrates a schematic plan cross-sectional view of the insertion part 11. Note that FIG. 16 is a schematic view and corresponds to both the insertion parts 11*a* and 11*b* of the insertion parts 11.

Figure 19:
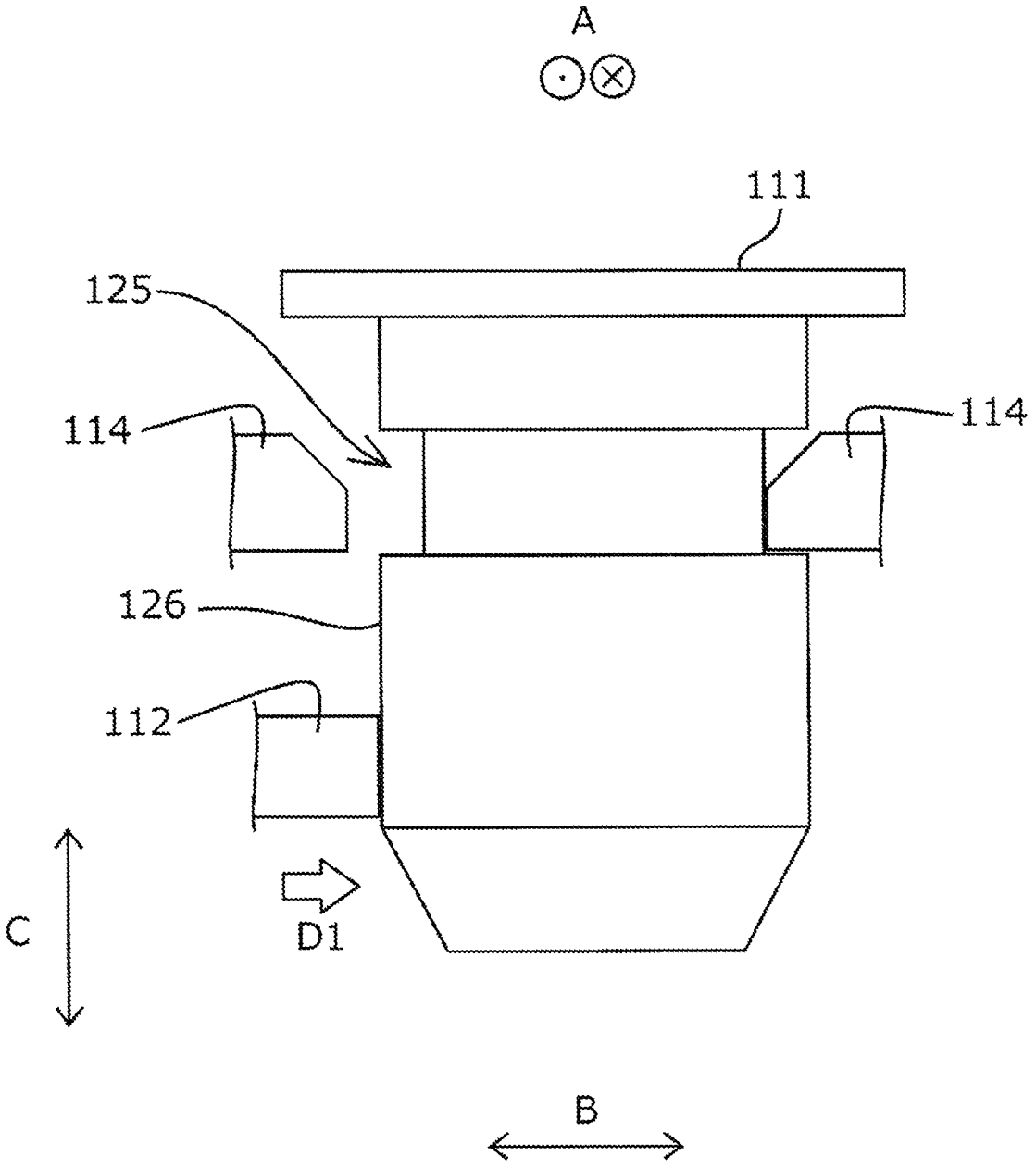
FIG. 19 is a schematic front cross-sectional view illustrating a main part of a printing apparatus according to a reference example.
Figure 20:
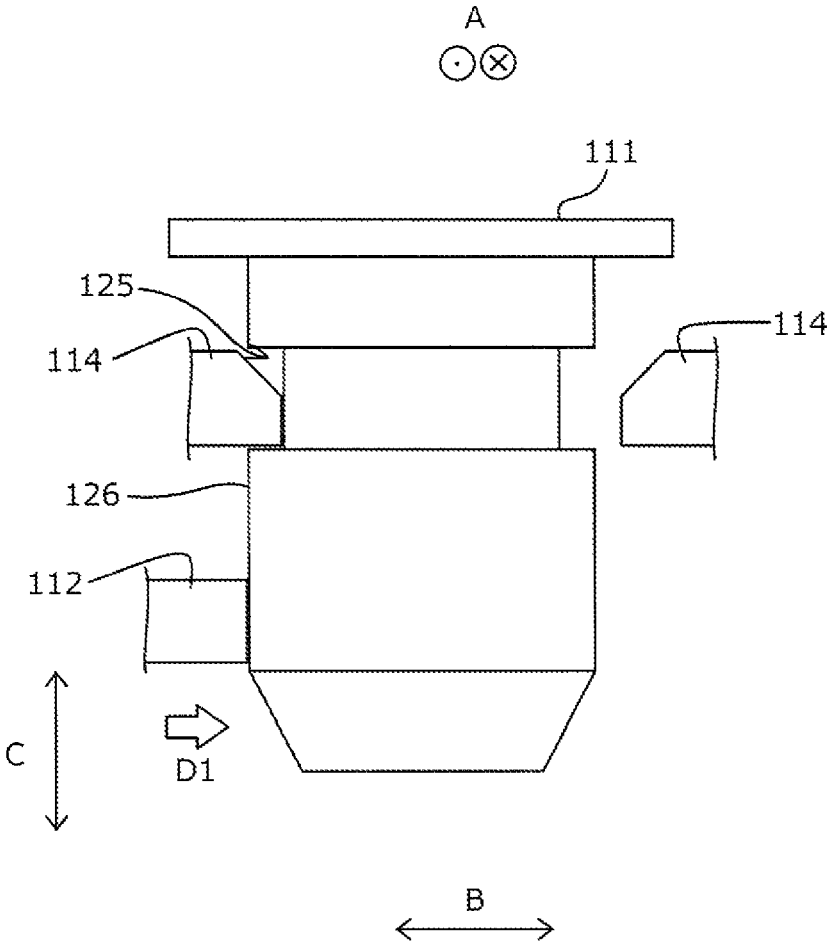
FIG. 20 is a schematic front cross-sectional view illustrating a main part of the printing apparatus according to the reference example.

In addition, FIG. 19 and FIG. 20 are schematic front cross-sectional views of a fixing part in a printing apparatus according to a reference example, illustrating a state in which an insertion part 111 is inserted into an insertion inlet of a bush 114 up to a fixing position. FIG. 19 and FIG. 20 are views corresponding to FIG. 14 and FIG. 15 for comparison, respectively. FIG. 19 illustrates a state in which the insertion part 111 is pressed by a pressing part 112 in the pressing direction D1. FIG. 20 illustrates a state in which the insertion part 111 is pressed by a user toward the opposite side of the pressing direction D1.

As illustrated in FIG. 14 to FIG. 16 and the like, on the insertion part 11 according to the example, an indented part 25 is formed extending in the circumferential direction of an intersecting direction which intersects with the attachment/detachment direction C. Specifically, the indented part 25 is a part dented toward the inside of the insertion part 11. Here, in a configuration in which the indented part 25 is formed in the circumferential direction, when the indented part 25 is formed, the indented part 25 can be formed while rotating the insertion part 11. Therefore, the indented part 25 can be formed easily and at a low cost.

Note that on both the insertion parts 11*a* and 11*b* of the insertion parts 11, the indented part 25 as illustrated in FIG. 14 to FIG. 16 and the like is formed. In addition, on the upper side (the side where the tray 4 is mounted) and the lower side with respect to the indented part 25 in the attachment/detachment direction C, a non-indented part 26 is formed. In other words, the non-indented part 26 is formed at a position different from the position of the indented part 25 in the attachment/detachment direction C. Specifically, the non-indented part 26 is a part not dented on the insertion part 11. In other words, the non-indented part 26 is a part protruding outward further than the indented part 25 on the insertion part 11.

In addition, as illustrated in FIG. 8 to FIG. 13 and the like, as for the bushes 14 according to the example, the bush 14*a* and 14*b* together include first fixing parts 22 (first fixing parts 22*a* and 22*b*) having a smaller thickness than the indented part 25 (the length in the attachment/detachment direction C) and second fixing parts 23 (second fixing parts 23*a* and 23*b*) having a greater thickness than the indented part 25.

In the fixing part 24 according to the example, because the insertion part 11 and the bushes 14 have such a configuration, as illustrated in FIG. 14, when the insertion part 11 is inserted into the insertion inlet 13 of the bush 14 up to the fixing position and the insertion part 11 is pressed by the pressing part 12 toward the first fixing part 22, the indented part 25 and the first fixing part 22 engage with each other and thus the tray 4 is fixed to the stage 5. On the other hand, from a state in which the insertion part 11 is inserted into the insertion inlet 13 of the bush 14 up to the fixing position, as illustrated in FIG. 15, when the insertion part 11 is pressed by the user toward the second fixing part 23, the engagement between the indented part 25 and the first fixing part 22 is released. In addition, the non-indented part 26 and the second fixing part 23 come into contact with each other, and thus the fixation of the tray 4 to the stage 5 is released. In other words, when the insertion part 11 is pressed by the user to the opposite side of the pressing direction D1, the fixation of the tray 4 is released. Note that the fixing position is a position set as the position to which, when the insertion part 11 is inserted into the insertion inlet 13, the insertion part 11 is sufficiently inserted into the insertion inlet 13 to fix the tray 4.

On the other hand, the configuration illustrated in FIG. 19 and FIG. 20 includes the insertion part 111 on which a indented part 125 is formed in the circumferential direction and a non-indented part 126 is formed on the upper side and the lower side of the indented part 125 like the insertion part 11 according to the example, the pressing part 112 like the pressing part 12 according to the example, and the bush 114 including only a fixing part with a smaller thickness than the indented part 125. In this configuration, the indented part 125 engages with the bush 114 in the state illustrated in FIG. 20 in addition to the state illustrated in FIG. 19. In other words, when the insertion part 111 is pressed by the user to the opposite side of the pressing direction D1, the fixation of the tray is not released. Thus, in the printing apparatus according to the reference example illustrated in FIG. 19 and FIG. 20, releasing the fixation of the tray example is not easy.

Note that in the case of the insertion part 111 having a configuration in which the indented part 125 is formed only on the downstream side in the pressing direction D1 rather than the indented part 125 being formed to extend in the circumferential direction, even with the fixing part in the printing apparatus according to the reference example, when the tray is set in the correct orientation, releasing the fixation of the tray is easy. However, forming the insertion part 111 (the indented part 125) will be difficult and at a high cost. In addition, in this case, when the tray is set in the opposite orientation to the correct orientation, even when the insertion part 111 is pressed in the opposite side of the pressing direction D1, the fixation of the tray is not released. Thus, care is needed in setting the orientation of the tray.

Here, to summarize, the printing apparatus 1 according to the example includes the tray 4 including the insertion part 11 to which the indented part 25 is provided and configured to support the medium M, the stage 5 including the insertion inlet 13 into which the insertion part 11 is insertable, the stage 5 being configured to have the supporting unit 4 attach and detach to/from the stage 5 along the attachment/detachment direction C, and the fixing part 24 that, when the insertion part 11 is inserted into the insertion inlet 13 up to the fixing position, fixes the insertion part 11 to the insertion inlet 13 at the fixing position. The fixing part 24 includes the first fixing part 22 provided on one side in the intersecting direction which intersects with the attachment/detachment direction C (one side in the direction along the scanning direction B), and the second fixing part 23 provided on the other side in the intersecting direction (the other side in the direction along the scanning direction B). When the insertion part 11 is inserted up to the fixing position, the first fixing part 22 is configured to engage with the indented part 25 when the indented part 25 is located at the position facing the first fixing part 22 (refer to FIG. 14), and the second fixing part 23 is configured to not engage with the indented part 25 when the indented part 25 is located at the position facing the second fixing part 23 (refer to FIG. 15).

As described above, the printing apparatus 1 according to the example includes the first fixing part 22 that engages with the indented part 25 when the indented part 25 is located at the facing position and the second fixing part 23 that does not engage with the indented part 25 when the indented part 25 is located at the facing position, when the insertion part 11 is inserted up to the fixing position. That is, the indented part 25 engages with the first fixing part 22 but does not engage with the second fixing part 23. Thus, even when the tray 4 including the insertion part 11 having a configuration with the indented part 25 formed only on the downstream side in the pressing direction D1 rather than the indented part 25 being formed extending in the circumferential direction is used and when the tray 4 is set in the correct orientation (when the indented part 25 is located at the position facing the first fixing part 22), the tray 4 can be securely fixed. In addition, even when the tray 4 is set in a wrong orientation (when the indented part 25 is located at the position facing the second fixing part 23), difficulty in releasing the fixation of the tray 4 can be prevented.

Note that the printing apparatus 1 according to the example employs the tray 4 including the insertion part 11 having the configuration with the indented part 25 formed in the circumferential direction, thus, the tray 4 is configured to be set by changing the orientation of the tray 4 by 180° in the movement direction A. Additionally, in whichever orientation the tray 4 is set, the tray 4 can be securely fixed and the difficulty in releasing the fixation of the tray 4 can be prevented.

Describing the description above in other words, according to the example, by using the printing apparatus 1 including the supporting unit (the tray 4) including the insertion part 11 to which the indented part 25 is provided and configured to support the medium M, the stage 5 including the insertion inlet 13 into which the insertion part 11 is insertable, the stage 5 being configured to have the tray 4 attach and detach to/from the stage 5 along the attachment/detachment direction C, and the fixing part 24 that, when the insertion part 11 is inserted into the insertion inlet 13 up to the fixing position, fixes the insertion part 11 to the insertion inlet 13 at the fixing position, with the fixing part 24 including the first fixing part 22 provided on one side in the intersecting direction which intersects with the attachment/detachment direction C and the second fixing part 23 provided on the other side in the intersecting direction, when the insertion part 11 is inserted up to the fixing position, the first fixing part 22 is engaged with the indented part 25 when the indented part 25 is located at the position facing the first fixing part 22, and the second fixing part 23 is not engaged with the indented part 25 when the indented part 25 is located at the position facing the second fixing part 23, and thus a method of fixing the support unit that fixes the tray 4 at the fixing position can be performed.

In the method of fixing the support unit as described above, when the insertion part 11 is inserted up to the fixing position and the indented part 25 is located at the facing position, the first fixing part 22 is engaged with the indented part 25 but the second fixing part 23 is not engaged with the indented part 25. That is, the indented part 25 engages with the first fixing part 22 but does not engage with the second fixing part 23. Thus, even when the tray 4 including the insertion part 11 having a configuration with the indented part 25 formed only on the downstream side in the pressing direction D1 rather than the indented part 25 being formed extending in the circumferential direction is used and when the tray 4 is set in the correct orientation (when the indented part 25 is located at the position facing the first fixing part 22), the tray 4 can be securely fixed. In addition, even when the tray 4 is set in a wrong orientation (when the indented part 25 is located at the position facing the second fixing part 23), difficulty in releasing the fixation of the tray 4 can be prevented.

In addition, as illustrated in FIG. 15, in the printing apparatus 1 according to the example, the non-indented part 26 is provided on the insertion part 11 at a position different from the position of the indented part 25 in the attachment/detachment direction C. The second fixing part 23 is configured to, when the insertion part 11 is inserted up to the fixing position and the indented part 25 is located at the position facing the second fixing part 23, come into contact with the non-indented part 26 and thus not engage with the indented part 25. As described above, the printing apparatus 1 according to the example forms a simple configuration in which the second fixing part 23 does not engage with the indented part 25.

More specifically, as illustrated in FIG. 15, the second fixing part 23 is configured to, when the insertion part 11 is inserted up to the fixing position and the indented part 25 is located at the position facing the second fixing part 23, come into contact with the non-indented part 26 provided at the position on the lower side (downward) with respect to the indented part 25 in the attachment/detachment direction C. Specifically, the second fixing part 23 is configured to be located at least at a position on the lower side with respect to the indented part 25 when the insertion part 11 is inserted up to the fixing position. Thus, the printing apparatus 1 according to the example has a configuration in which the second fixing part 23 can be prevented from being caught by the indented part 25 when the tray 4 is detached from the stage 5.

In addition, as illustrated in FIG. 9 and FIG. 12, FIG. 14 and FIG. 15, and the like, the second fixing part 23 according to the example is configured to have a greater thickness than the first fixing part 22. In the first fixing part 22 and the second fixing part 23, the thickness corresponds to the length in the attachment/detachment direction C. Thus, in other words, the length of the second fixing part 23 according to the example in the attachment/detachment direction C is configured to be greater than the length of the first fixing part 22 in the attachment/detachment direction C. In addition, in the configuration described above, the first fixing parts 22 (the first fixing parts 22*a* and 22*b*) are formed having a smaller thickness than the indented part 25 and the second fixing parts 23 (the second fixing parts 23*a* and 23*b*) are formed having a greater thickness than the indented part 25. Because the first fixing part 22 and the second fixing part 23 have the configuration as described above, the printing apparatus 1 according to the example forms a simple configuration in which the second fixing part 23 comes into contact with the non-indented part 26 and thus the second fixing part 23 does not engage with the indented part 25.

In addition, as described above, the printing apparatus 1 according to the example includes the pressing part 12 that, when the insertion part 11 is inserted up to the fixing position, presses the insertion part 11 in the pressing direction D1 toward the first fixing part 22 in the intersecting direction which intersects with the attachment/detachment direction C. Thus, the printing apparatus 1 according to the example has a configuration in which the first fixing part 22 and the indented part 25 can be engaged with a simple configuration and thus the tray 4 can be fixed as appropriate with a simple configuration.

Note that in the printing apparatus 1 according to the example, the pressing direction D1 is a direction which intersects with the attachment/detachment direction C and also intersects with the movement direction A of the medium support unit 2. Because the pressing direction D1 is the direction as described above, the tray 4 can be prevented from vibrating (rattling) against the stage 5 accompanying the movement of the medium support unit 2.

In addition, as described above, the printing apparatus 1 according to the example has a configuration in which, the engagement between the first fixing part 22 and the indented part 25 is released from a state in which the first fixing part 22 and the indented part 25 engage with each other (refer to FIG. 14) by moving the tray 4 in an opposite direction of the pressing direction D1 (refer to FIG. 15. Therefore, the printing apparatus 1 according to the example has a configuration in which pressing in the opposite direction of the pressing direction D1 can easily release the fixation of the tray 4 in the first fixing part 22.

In addition, as illustrated in FIG. 14 and FIG. 15, in the printing apparatus 1 according to the example, the insertion part 11 includes the indented part 25 provided at least on one side in the intersecting direction which intersects with the attachment/detachment direction C (on the side of the first fixing part 22) and on the other side in the intersecting direction (on the side of the second fixing part 23). Thus, as described above, the printing apparatus 1 according to the example has a configuration in which the tray 4 can be set by changing the orientation of the tray 4 by 180° in the movement direction A, the tray 4 can be securely fixed to the stage 5 in two types of orientation, and in both the two types of orientation the difficulty in releasing the fixation of the tray 4 can be prevented.

Specifically, as illustrated in FIG. 16, the insertion part 11 includes the indented part 25 provided to make one lap around the outer peripheral surface in the intersecting direction which intersects with the attachment/detachment direction C. Thus, in the printing apparatus 1 according to the example, the tray 4 can be securely fixed to the stage 5 in a plurality of types of orientation, and when the indented part 25 is formed, the indented part 25 is formed while rotating the insertion part 11 with the attachment/detachment direction C as the axis, and thus the indented part 25 can be easily formed.

Figure 17:
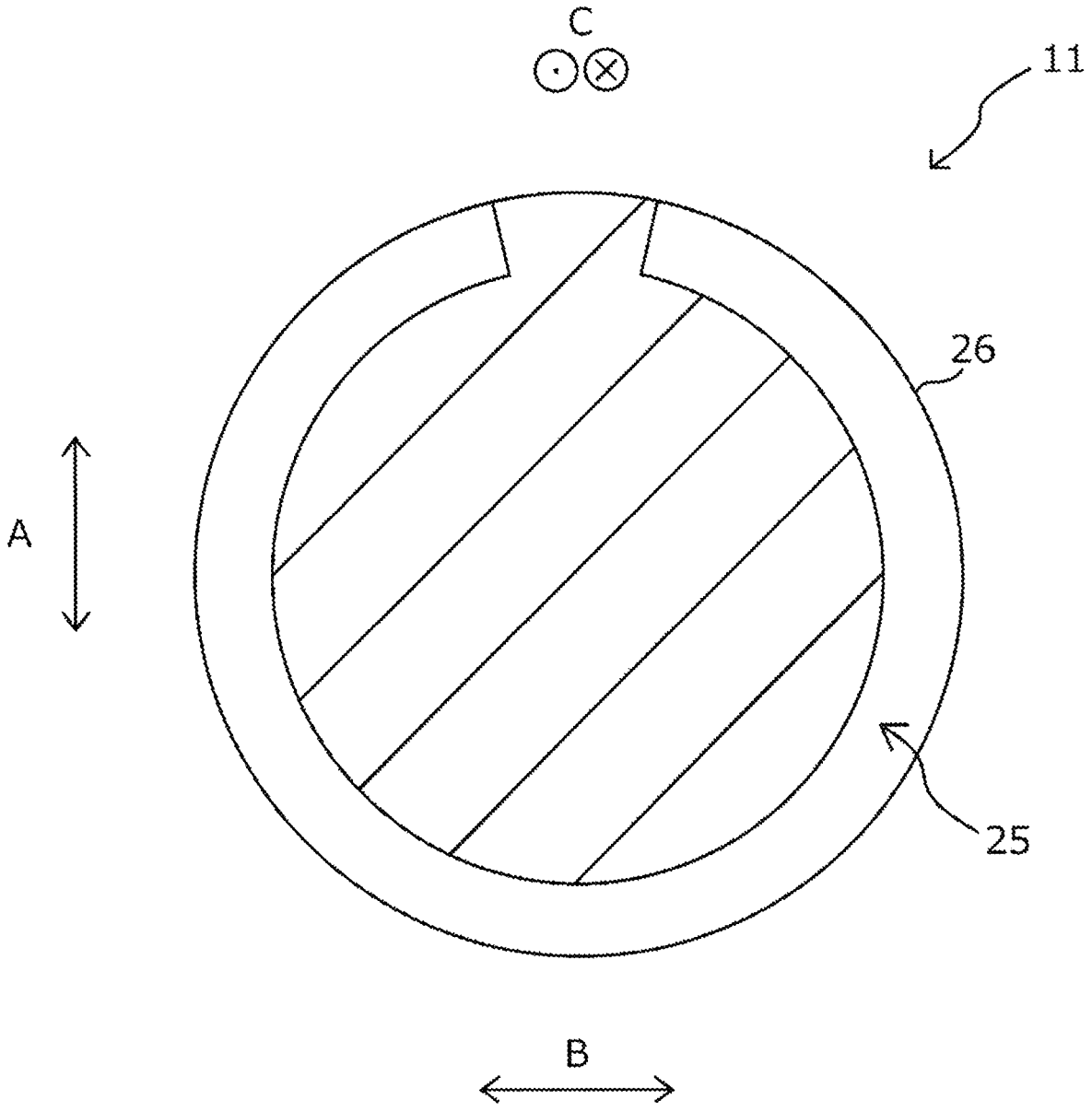
FIG. 17 is a schematic plan cross-sectional view illustrating a main part of a printing apparatus according to Example 2 of the invention.
Figure 18:
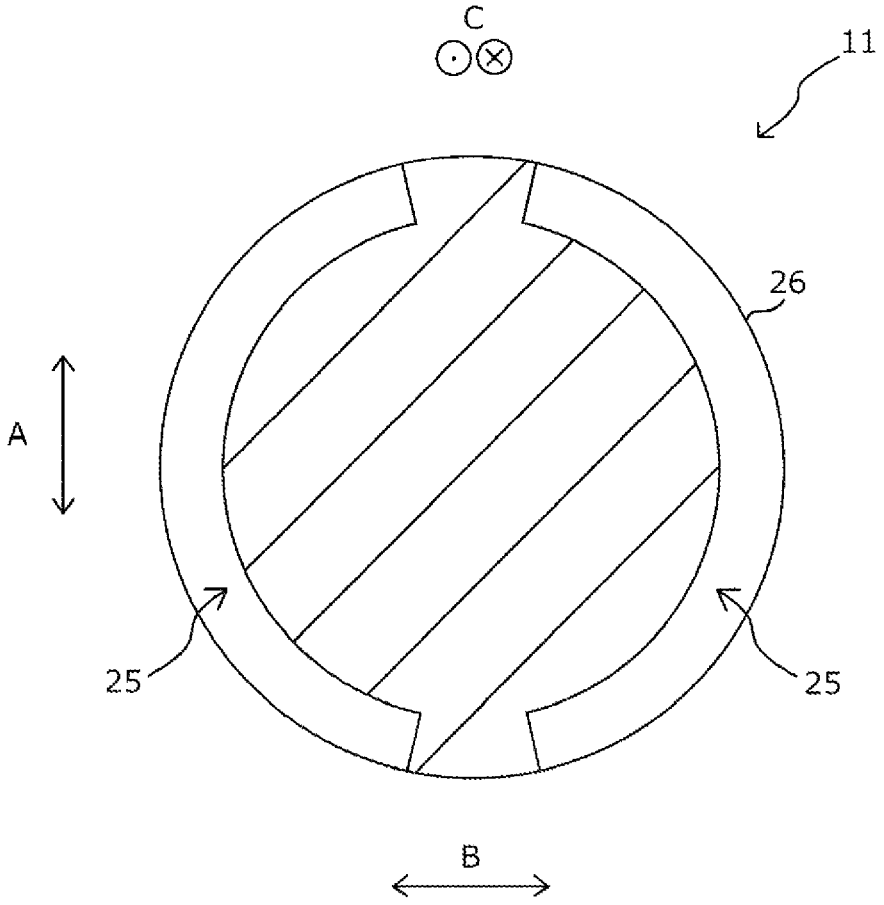
FIG. 18 is a schematic plan cross-sectional view illustrating a main part of a printing apparatus according to Example 3 of the invention.

Example 2 (FIG. 17) and Example 3 (FIG. 18)

Next, printing apparatuses 1 according to Example 2 and Example 3 will be described in detail with reference to the appended drawings.

FIG. 17 illustrates a schematic plan cross-sectional view of the insertion part 11 in the medium support unit 2, which is a main part of the printing apparatus 1 according to Example 2. FIG. 17 is a view corresponding to FIG. 16 of the printing apparatus 1 according to Example 1. In addition, FIG. 18 illustrates a schematic plan cross-sectional view of the insertion part 11 in the medium support unit 2, which is a main part of the printing apparatus 1 according to Example 3. FIG. 18 is a view corresponding to FIG. 16 of the printing apparatus 1 according to Example 1. Here, component elements common to the component elements in the above-described Example 1 are denoted by identical reference signs, and detailed descriptions of those component elements will be omitted.

Note that both the printing apparatuses 1 in Example 2 and Example 3 have an identical configuration to the printing apparatus 1 of Example 1 except for the shape of the indented part 25 formed on the insertion part 11.

As illustrated in FIG. 17, in the printing apparatus 1 according to Example 2, the insertion part 11 includes indented part 25 provided at least on one side in the intersecting direction which intersects with the attachment/detachment direction C (one side in the direction along the scanning direction B) and on the other side in the intersecting direction (the other side in the direction along the scanning direction B). On the other hand, the insertion part 11 includes a region in which the indented part 25 is not formed at an end portion on one side in the direction along the movement direction A. That is, the insertion part 11 includes the indented part 25 provided to not make one lap around the outer peripheral surface in the intersecting direction which intersects with the attachment/detachment direction C.

In addition, as illustrated in FIG. 18, the insertion part 11 in the printing apparatus 1 according to Example 3, includes the indented part 25 provided on one side in the intersecting direction which intersects with the attachment/detachment direction C (one side in the direction along the scanning direction B) and on the other side in the intersecting direction (the other side in the direction along the scanning direction B). On the other hand, the insertion part 11 includes a region in which the indented part 25 is not formed at an end portion on one side and an end portion on the other side in the direction along the movement direction A. That is, the insertion part 11 includes the indented part 25 provided to not make one lap around the outer peripheral surface in the intersecting direction which intersects with the attachment/detachment direction C.

As described above, the insertion part 11 does not include the indented part 25 provided to make one lap around the outer peripheral surface in the intersecting direction which intersects with the attachment/detachment direction C. Furthermore, the configuration may be made such that the indented part 25 is provided only on one side of the intersecting direction which intersects with the attachment/detachment direction C. That is, provided that at least the indented part 25 is formed on the side of the first fixing part 22 when the insertion part 11 is inserted into the insertion inlet 13 in the correct orientation, the shape and disposition of the indented part 25 have no limitation in particular.

Note that the invention is not intended to be limited to the aforementioned example, and many variations are possible within the scope of the invention as disclosed in the appended claims. It goes without saying that such variations also fall within the scope of the invention.

This application claims priority under 35 U.S.C. § 119 to Japanese Patent Application No. 2017-202413, filed Oct. 19, 2017. The entire disclosure of Japanese Patent Application No. 2017-202413 is hereby incorporated herein by reference.

What is claimed is:

1. A printing apparatus comprising:

a supporting unit including an insertion part on which an indented part is provided, the supporting unit being configured to support a medium;

a base unit including an insertion inlet into which the insertion part is insertable, the base unit being configured to have the supporting unit attach and detach to/from the base unit along an attachment/detachment direction; and a fixing part configured to, when the insertion part is inserted into the insertion inlet up to a fixing position, fix the insertion part to the insertion inlet at the fixing position, wherein the fixing part includes a first fixing part provided on one side in an intersecting direction which intersects with the attachment/detachment direction, and a second fixing part provided on the other side in the intersecting direction, and when the insertion part is inserted up to the fixing position, the first fixing part is configured to engage with the indented part when the indented part is located at a position facing the first fixing part, and the second fixing part is configured to not engage with the indented part when the indented part is located at a position facing the second fixing part.

2. The printing apparatus according to claim 1, wherein a non-indented part is provided on the insertion part at a position different from the indented part in the attachment/detachment direction, and the second fixing part is configured to, when the insertion part is inserted up to the fixing position and the indented part is located at a position facing the second fixing part, come into contact with the non-indented part and not engage with the indented part.

3. The printing apparatus according to claim 2, wherein the second fixing part is configured to, when the insertion part is inserted up to the fixing position and the indented part is located at a position facing the second fixing part, come into contact with the non-indented part provided at a position on a lower side with respect to the indented part in the attachment/detachment direction.

4. The printing apparatus according to claim 1, wherein a length of the second fixing part in the attachment/detachment direction is greater than a length of the first fixing part in the attachment/detachment direction.

5. The printing apparatus according to claim 1, further comprising:

a pressing part configured to, when the insertion part is inserted up to the fixing position, press the insertion part in a pressing direction toward the first fixing part in the intersecting direction.

6. The printing apparatus according to claim 5, wherein an engagement between the first fixing part and the indented part is released from a state in which the first fixing part and the indented part engage with each other by moving the supporting unit in an opposite direction of the pressing direction.

7. The printing apparatus according to claim 1, wherein the insertion part includes the indented part provided at least on one side in the intersecting direction and on the other side in the intersecting direction.

8. The printing apparatus according to claim 7, wherein the insertion part includes the indented part provided to make one lap around an outer peripheral surface in the intersecting direction.

9. A method of fixing a support unit in a printing apparatus including a supporting unit including an insertion part on which an indented part is provided, the supporting unit being configured to support a medium;

a base unit including an insertion inlet into which the insertion part is insertable, the base unit being configured to have the supporting unit attach and detach to/from the base unit along an attachment/detachment direction; and a fixing part configured to, when the insertion part is inserted into the insertion inlet up to a fixing position, fix the insertion part to the insertion inlet at the fixing position, wherein the fixing part includes a first fixing part provided on one side in an intersecting direction which intersects with the attachment/detachment direction, and a second fixing part provided on the other side in the intersecting direction, the method comprising:

fixing the supporting unit at the fixing position by, when the insertion part is inserted up to the fixing position, engaging the first fixing part with the indented part when the indented part is located at a position facing the first fixing part, and not engaging the second fixing part with the indented part when the indented part is located at a position facing the second fixing part.

* * * * *